United States Patent [19]

Van Esdonk

[11] 4,164,059

[45] Aug. 14, 1979

[54] METHOD OF MANUFACTURING A COLOR DISPLAY TUBE AND COLOR DISPLAY TUBE MANUFACTURED BY SAID METHOD

[75] Inventor: Johannes Van Esdonk, Eindhoven, Netherlands

[73] Assignee: U.S. Philips Corporation, New York, N.Y.

[21] Appl. No.: 897,735

[22] Filed: Apr. 19, 1978

Related U.S. Application Data

[63] Continuation of Ser. No. 757,675, Jan. 7, 1977, abandoned.

[30] Foreign Application Priority Data

Jan. 16, 1976 [NL] Netherlands ..... 7600421

[51] Int. Cl.[2] ..... H01J 9/02

[52] U.S. Cl. ..... 29/25.15; 29/25.18

[58] Field of Search ..... 29/25.13, 25.14, 25.15, 29/25.16, 25.17, 25.18; 156/630, 633, 634, 644, 331

[56] References Cited

U.S. PATENT DOCUMENTS

| | | | |
|---|---|---|---|
| 3,186,883 | 6/1965 | Frantzen | 156/634 X |
| 3,586,900 | 6/1971 | Seki et al. | 313/85 |
| 3,680,184 | 8/1972 | Greene | 29/25.14 |
| 3,688,359 | 9/1972 | Oikawa et al. | 29/25.14 |
| 3,787,106 | 1/1974 | Schermerhorn | 316/17 |
| 3,799,816 | 3/1974 | Schneble, Jr. et al. | 156/644 |
| 3,999,263 | 12/1976 | Marshall et al. | 29/25.14 |

*Primary Examiner*—Richard B. Lazarus
*Attorney, Agent, or Firm*—Algy Tamoshunas

[57] ABSTRACT

A focusing shadow mask incorporating an electrostatic lens at each mask aperture is produced by creating an electrode comprising a set of parallel conductors on one surface of an insulator sheet and a second electrode on the other surface. The second electrode has apertures defined either by a second set of parallel conductors that are perpendicular to the first set or by a conductive grid that includes conductors parallel to the first set and other conductors perpendicular to the first set. Additional metal can be built up on either electrode to strengthen the combined structure. After formation of both electrodes, the areas of the insulating material are selectively etched away to form apertures for beams to pass through.

7 Claims, 8 Drawing Figures

Figure 1:
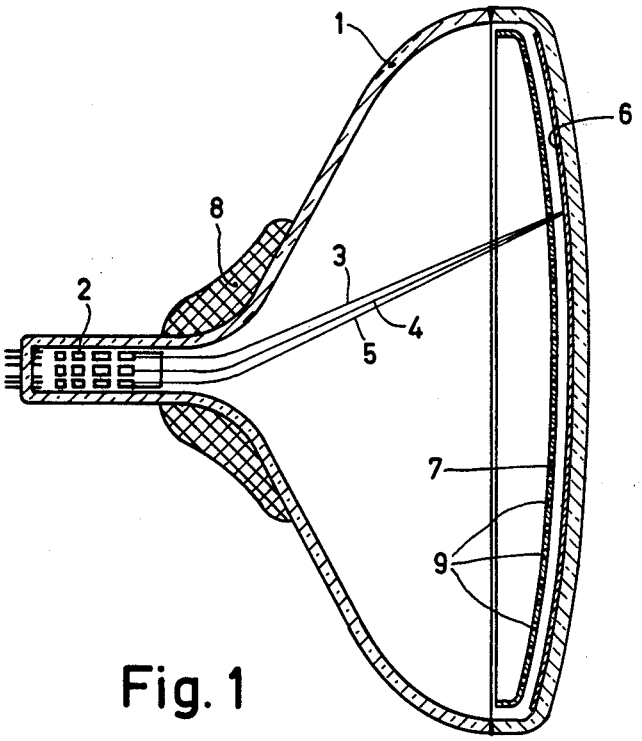

METHOD OF MANUFACTURING A COLOR DISPLAY TUBE AND COLOR DISPLAY TUBE MANUFACTURED BY SAID METHOD

This is a continuation of application Ser. No. 757,675, filed Jan. 7, 1977 now abandoned.

The invention relates to a method of manufacturing a colour display tube comprising in an evacuated envelope an electrode system to generate at least two electron beams, a display screen covered with a large number of regions luminescing in different colours, and colour selection means arranged at a short distance in front of the display screen for assigning each electron beam to luminescent regions of one colour. The colour selection means comprises a first and a second system of lens electrodes, the lens electrode of to the first system mechanically being connected to the lens electrode of the second system by means of an insulating member.

The invention furthermore relates to a colour display tube manufactured according to the method.

In colour display tubes, the colour selection means usually used is in the form of a perforated plate which is arranged at a short distance in front of before the display screen and which is usually referred to as a shadow mask. The drawback of such a shadow mask is that a large part, for example 80 to 85%, of the electrons are intercepted, which imposes restrictions upon the maximum achievable brightness of the displayed picture. It is known to increase the brightness of the displayed picture by enlarging the apertures in the colour selection means and postfocusing the electron beams.

One such postfocusing type tube is disclosed in U.S. Pat. No. 3,398,309.In this tube, a lens of the unipotential type is formed in each of the apertures of the colour selection means. Such, lenses require a rather large voltage difference between the electrodes which form the lens.

It is an object of the invention to provide a method of manufacturing a colour display tube of the post-focusing type in which the colour selection means is of a simple construction. Another object of the invention is to provide such a colour display tube in which the colour selection means comprises only two systems of lens electrodes in such manner that, when a voltage difference is applied between the said two systems, a quadrupole lens is formed in each of the apertures of the colour selection means.

According to the invention, a method of manufacturing a colour display tube of the kind mentioned in the preamble is characterized in that the starting material for the manufacture of the colour selection means is an electrically insulating foil or sheet on which a first system of lens electrodes is formed on one side and a second system of lens electrodes is formed on the other side and the desired apertures in the colour selection means are obtained by the locally etching through the insulating foil.

The starting material for the manufacture of the colour selection means is preferably an insulating foil which is coated on both sides with a metal layer. One of the metal layers is locally etched away to form a first system of lens electrodes and the other metal layer is locally etched away to form a second system of lens electrodes. Known photographic methods may be used for the local etching-away of the metal layers.

According to another suitable embodiment of the method according to the invention the two systems of lens electrodes are obtained directly by depositing metal on the opposite sides of the insulating foil. In order to obtain the desired pattern of the system of lens electrodes, photographic methods may also be used in this case, while the metal may be deposited by known methods, such as vapour deposition or sputtering.

A particularly suitable embodiment of the colour selection means is obtained by forming on one side of the insulating foil a system of lens electrodes resulting in a metal coating provided with apertures arranged in rows, forming on the other side of the insulating foil a system of lens electrodes resulting in a metal grid of mutually connected strips which are positioned between the rows of apertures, and etching-through the foil at least at the area of the apertures. In the colour selection means obtained according to this embodiment, a quadrupole lens, the electric field of which is at right angles to or substantially at right angles to the passing electron beams, is formed in each of the apertures of the colour selection means when a voltage difference is applied between the first and the second system of lens electrodes. The advantage of the colour selection means constructed according to the invention, as compared with those made according to the above cited United States patent is that they can be operated at a lower voltage difference because a quadrupole lens is comparatively stronger than a unipotential lens. That a quadrupole lens focuses in one direction and defocuses in a direction at right angles thereto is, in principle, not a drawback when the luminescent regions on the display screen have the shape of substantially parallel strips the longitudinal direction of which is parallel to the defocusing direction of the quadrupole lenses.

Another embodiment of the colour selection means is obtained by forming on one side of the insulating foil a system of lens electrodes resulting in a first metal grid of strips which are connected together electrically, forming on the other side of the insulating foil a system of lens electrodes resulting in a second metal grid of strips which are connected together electrically, which second grid crosses the first grid, and then etching-through the foil between the strips belonging to the same grid. In the colour selection means thus obtained, a quadrupole lens is also formed in each of the apertures when a voltage difference is applied between the first and the second grid. In the colour selection means obtained according to this method, the insulating foil does not contribute or contributes only slightly to the rigidity of the colour selection means. In particular when parts of the insulating foil remain only on the crossings of the strips, the mechanical rigidity of the colour selection means is fully determined by the rigidity of the strips forming the grids. In that case it is recommendable to reinforce at least one of the grids by providing thereon an extra metal layer. This may be done by electroplating or chemically.

Insulating foils suitable for use in the method of the invention are glass foil and, in particular, synthetic foils. Polyimide foils are preferably used of which in particular the polyimide of 1-2-4-5 benzene-tetracarbonic acid dianhydride and 4-4' diaminodiphenyl ether satisfies the object underlying the invention.

Figure 2:
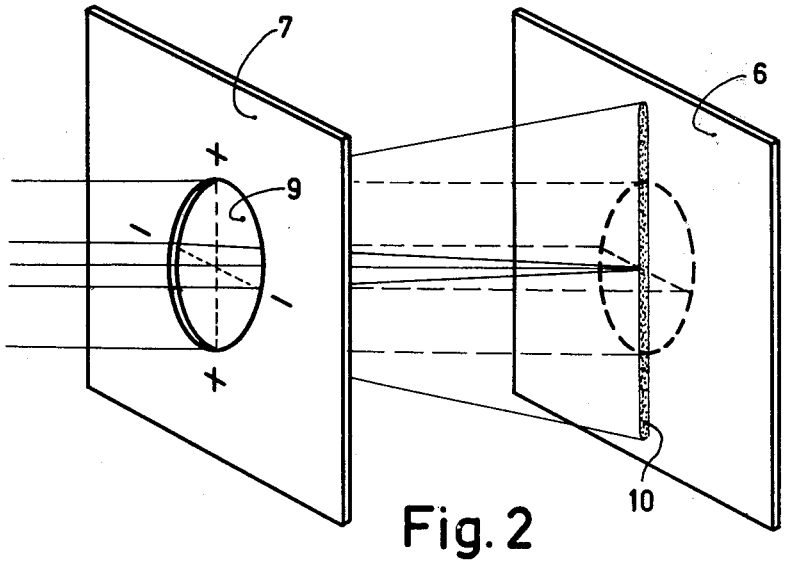
Figure 3A:
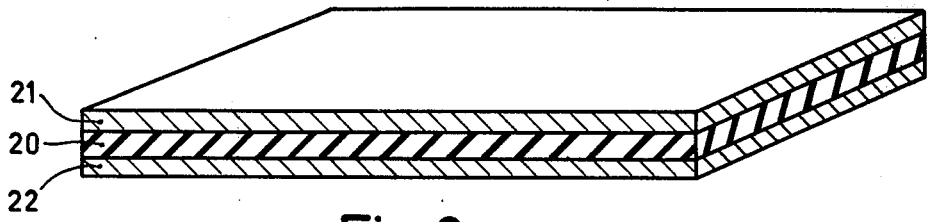
Figure 3B:
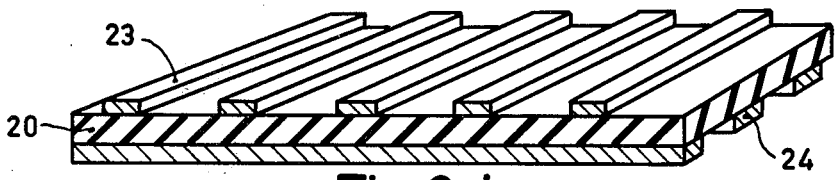
Figure 3C:
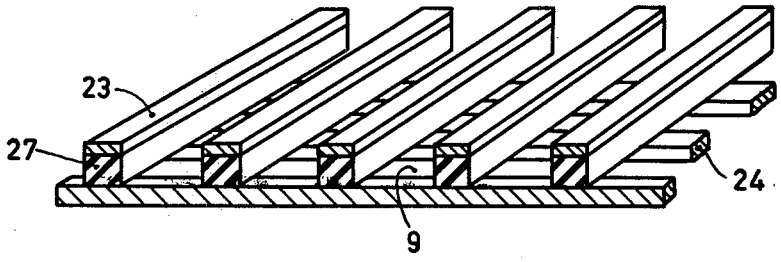
Figure 3D:
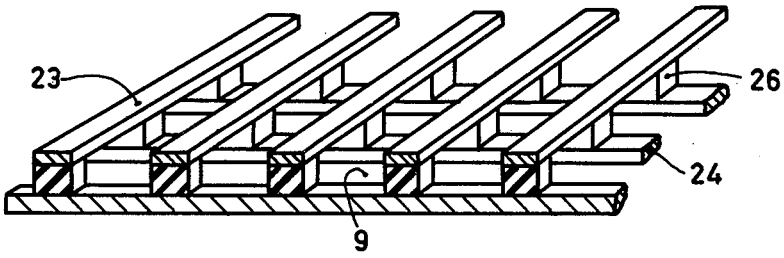
Figure 4:
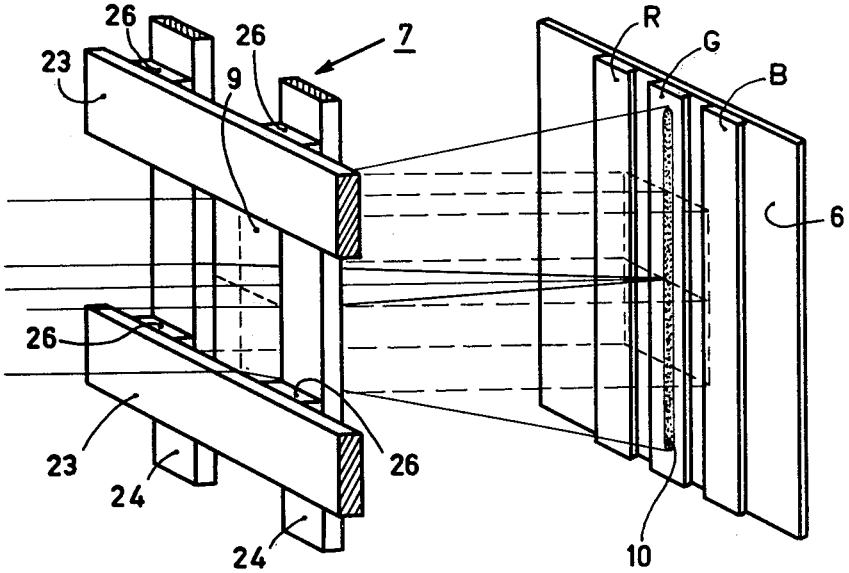
Figure 5:
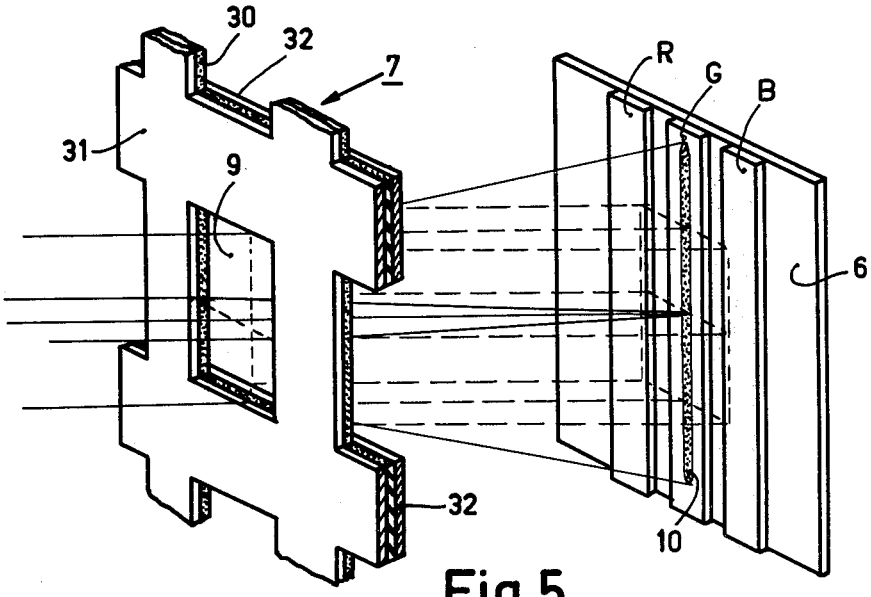

The invention will be described in greater detail with reference to the drawing, in which:

FIG. 1 is a horizontal sectional view of the colour display tube according to the invention, FIG. 2 shows the principle of the postfocusing effect of a quadrupole lens, FIGS. 3*a, b, c* and *d* illustrate an embodiment of the method according to the invention, FIG. 4 shows a detail of the colour selection means shown in FIG. 3*d*, and FIG. 5 shows a detail of another embodiment of the colour selection means.

The tube shown in FIG. 1 comprises a glass envelope 1, means 2 to generate three electron beams 3, 4 and 5, a display screen 6, colour selection means 7 and deflection coils 8. The electron beams 3, 4 and 5 are generated in one plane, the plane of the drawing of FIG. 1, and are deflected over the display screen 6 comprising a large number of phosphor strips luminescing red, green and blue, the longitudinal direction of which is at right angles to the plane of the drawing of FIG. 1. During normal operation of the tube the phosphor strips are vertical and FIG. 1, hence, is a horizontal sectional view of the tube. The colour selection means 7 has a large number of apertures 9 which are shown diagrammatically in FIG. 1. The three electron beams 3, 4 and 5 pass through the apertures 9 at a small angle with each other and consequently each impinges only upon phosphor strips of one colour. The apertures 9 in the colour selection means 7 are thus very accurately positioned relative to the phosphor strips of the display screen 6.

FIG. 2 shows the principle of the postfocusing effect of a quadrupole lens. Shown is a part of the colour selection means 7 and one of the apertures 9. The potential variation along the edge of the apertures 9 is denoted by +, −, +, − in such manner that a quadrupole lens is formed. The electron beam which passes through the aperture 9 is focused in the horizontal plane and is defocused in the vertical plane so that, when the display screen is exactly at the horizontal focus, the electron spot 10 is formed. As will be explained below it is recommendable not to focus the beams exactly on the display screen 6 so that a slightly wider electron spot is obtained. It is only of minor influence to the focusing when the electron beam passes through the aperture 9 at a small angle. The colour selection of the three electron beams 3, 4 and 5 takes place in a manner quite analogous to that of known shadow mask tubes. As a result of the strong focusing, however, the aperture 9 may be much larger than in known shadow masks so that a far greater number of electrons impinges on the display screen 6 and a brighter picture is obtained. The defocusing in a vertical direction need not be a drawback when phosphor strips are used which are parallel to the longitudinal direction of the spot 10.

A first embodiment of the colour selection means 7 is explained in detail with reference to FIGS. 3*a* to 3*d*. A 125 microns thick polyimide foil 20 is coated on two sides with metal layers 21 and 22, respectively. The foil consists of the polyimide of 1-2-4-5 benzenetetracarbonic acid dianhydride and 4-4′ diaminodiphenyl ether. Such a foil is commercially available as Kapton. The metal layers are provided on the foil by vapor deposition or sputtering and may consist, for example, of copper, nickel, cobalt, aluminium, iron, gold or a double layer of two of these metals. At least one of the layers preferably consists of a ferromagnetic material so as to screen the electron beam generated in the tube from the earth's magnetic field. A double layer is also possible, for example a first layer of copper on which a second layer of nickel is provided. The nickel layer may be provided by electroplating or according to a process known as electroless nickel plating. After a thickness of approximately 30 μm of the metal layers 21 and 22 has been obtained, the laminated plate shown in FIG. 3*a* is obtained. A layer of photoresist material is then provided on the two surfaces of the laminated plate and each layer is converted by photographic exposure and development into a pattern of parallel rods. The portions of the metal layers 21 and 22 exposed after development are removed by means of a suitable etching liquid. After removal of the remaining photoresist material, a foil 20 is obtained which is coated on both sides with metal strips 23 and 24, respectively, as shown in FIG. 3*b*. The strips 23 form a first system of lens electrodes and the strips 24 form a second system of lens electrodes. The conductors of each system are connected to each other by leaving a connection strip at the ends of the conductors (not shown in the Figure). In the following phase of the method, shown in FIG. 3*c*, the portions of the foil 20 disposed between the conductors 23 are etched away without attacking the conductors. An etchant suitable for this purpose consists of hydrazinehydrate or a diluted lye, preferably KOH, which is sprayed against the side of the foil 20 coated with the conductors 23. After removing these portions of the foil, a matrix of rectangular apertures 9 is obtained which forms the colour selection means.

Although in FIG. 3*c* the side faces of the rods 27 remaining on the foil 20 are shown to be straight, in fact some underetching occurs. This is not a drawback because as a result of this, the rods 27 are better protected against the electron beams by the lens electrodes. The possibility of charging, if any, of the insulation material by the electron beams can further be reduced by removing the part of the rods 27 situated between the conductors 24. As is shown in FIG. 3*d* only blocks 26 remain of the original foil, which blocks are situated at the areas where the conductors 23 cross the conductors 24.

Numerous variations of the above-described method are possible. Instead of first providing the metal layers 21 and 22 on the foil and etching the conductors out of said layers, it is also possible to provide the conductors directly on the foil according to the desired pattern. For that purpose the foil is coated on two sides with a layer of photoresist material in which a pattern of rods is provided photographically. A metal layer is then provided across this pattern, which layer does not adhere to the parts of the foil which are not coated with photoresist material. The remaining photoresist material of the foil is finally removed and only the metal adhering directly on the foil remains on the foil to form the desired pattern.

It is furthermore possible to first etch the conductors from the metal layer vapour-deposited on the foil and then to give the conductors the desired thickness, for example, electrolytically.

Instead of vapour-depositing or sputtering, it is furthermore possible to obtain the laminated plate shown in FIG. 3*a* by coating the foil 20 on two sides with a metal foil. For that purpose, the metal foils are wetted on one side with an adhesive consisting of the polyamide of 1-2-4-5 benzenetetracarbonic acid dianhydride and 4-4′ diaminodiphenyl ether. The two metal foils are then pressed against the polyimide foil 20 and the resulting assembly is heated in a furnace under a non-oxidizing atmosphere to a temperature of 350° C. for approximately 30 minutes. The polyamide is converted into the polyimide while expelling water and the metal foils rigidly adhere to the foil 20. For the rest the method may be continued as described with reference to FIGS. 3*b c* and *d*.

Although the invention has been explained with reference to an insulating foil of a polyimide, it is alternatively possible to use foils of other insulating material, for example glass. The advantage of a synthetic foil, however, is that it is not fragile and can be readily handled.

FIG. 4 shows, at an enlarged scale, a portion of the colour selection means shown in FIG. 3*d* situated around an aperture 9. The strips 23 and 24 have a width of 0.24 mm and each of the apertures 9 forms a square of 0.56×0.56 mm so that the transmission of the colour selection means is approximately 50%. For postfocusing the electron beams, of which FIG. 4 shows only the beam directed on the phosphor strip G, the colour selection means can be operated at the following voltages.

At a potential of the display screen 6 of 25 kV and a potential of the horizontal conductors 23 of 25.45 kV and of the vertical conductors 24 of 24.55 kV, the focal distance of the quadrupole lenses is 18.0 mm in the centre of the display screen with perpendicular incidence and is 12.7 mm at the edge of the curved display screen where the electron beams are incident at an angle of approximately 37° to the normal of the display screen. The distance of the colour selection means 7 to the display screen 6 is 50 mm in the center and 10 mm at the edge, so that the focus of the quadrupole lenses lies everywhere just slightly beyond the display screen. This prevents the so-called focus ring from becoming visible on the display screen. The electron spots in the center of the display screen are 0.10 mm wide and in the corners they are 0.09 mm wide. A suitable width of the phosphor strips, R, G and B is 0.13 mm. The remainder of the surface of the display screen may be coated with a light-absorbing material.

In the colour selection means 7 shown in FIG. 5, one system of lens electrodes consists of an aluminium raster 31 formed on a polyimide foil 30 and provided with rectangular apertures 9 of 0.54×0.54 mm. The second system of lens electrodes consists of a grid of nickel strips 32 shown horizontally in the drawing and having a width of 0.26 mm. The transmission of the colour selection means thus is again approximately 50%. The postfocusing effect of this embodiment of the colour selection means is analogous to that described with reference to FIG. 4, if during operation of the tube the raster 31 has a potential of approximately 23 kV and the strips 32 have a potential of approximately 25 kV at a potential of the display screen 6 of approximately 25 kV. An advantage of the colour selection means shown in FIG. 5 with respect to those of FIG. 4 is that the foil 30 contributes essentially to the mechanical rigidity of the colour selection means. An extra reinforcing layer on the strips 32 or the raster 31 is then not strictly necessary.

What is claimed is:

1. In the manufacture of a colour cathode ray tube having a focusing shadow mask, the method comprising the steps of: forming on one surface of an electrically insulating sheet a first electrode affixed to said sheet and having a plurality of elongated metallic conductors spaced from each other to define a first plurality of openings therebetween; forming on the opposite surface of said sheet a second electrode affixed to said sheet and having a plurality of elongated metallic conductors spaced from each other to define a second plurality of openings therebetween such that a portion of each opening of said second plurality is aligned with a portion of one of said openings of said first plurality; etching through said sheet at regions thereof aligned with said aligned portions of said openings to form apertures for passing electrons therethrough, said conductors of said first and second electrodes defining an electron lens for producing electron focusing fields in said apertures and with said sheet forming said shadow mask; and mounting said shadow mask in an envelope of the cathode ray tube.

2. The method according to claim 1, wherein said etching step includes etching away substantially all portions of said sheet not in contact with said conductors of said first and second electrodes so that the rigidity of the resultant shadow mask is determined mainly by said conductors of said first and second electrodes.

3. The method according to claim 1 wherein the step of forming said first electrode includes the step of etching away portions of a metal layer on said one surface of said sheet to form a first set of parallel metal strips defining said conductors of said first electrode and the step of forming said second electrode includes the step of etching away portions of a second metal layer on said opposite surface of said sheet to form a second set of parallel metal strips extending transversely of said strips of said first set, said strips of said second set defining said conductors of said second electrode.

4. The method according to claim 3 wherein said step of etching through said sheet includes underetching said sheet underlying said strips of one of said sets so that the remaining portions of said sheet are narrower than said strips of said one set.

5. The method according to claim 4 wherein the step of etching through said sheet includes etching away all portions of said sheet not sandwiched between said strips of said first and second sets.

6. The method according to claim 1 wherein said step of forming said first electrode includes etching away a plurality of substantially rectangular portions of a metal layer on said one surface of said sheet to leave two sets of parallel metal strips defining said elongated conductors of said first electrode, the strips of one of said sets extending perpendicularly to the strips of the other set; and the step of forming said second electrode includes the step of etching away portions of a second metal layer on said opposite surface of said sheet to leave a third set of parallel metal strips aligned with and parallel to the strips of one of said two sets, said strips of said third set defining said conductors of said second electrode.

7. The method according to claim 1 wherein said insulating sheet is made of synthetic material and said step of forming said first electrode includes the steps of adhereing a metal sheet to said one surface of said insulating sheet, said step of adhereing including applying to said metal sheet an adhesive of synthetic material convertible to said first-named synthetic material, pressing said metal sheet against said one surface and converting said adhesive to said first-named material; and removing selected areas of said metal sheet to form said first plurality of openings therein, said metal sheet with said openings formed therein defining said first electrode.

* * * * *